US005265319A

United States Patent [19]

Shimizu et al.

[11] Patent Number: 5,265,319

[45] Date of Patent: Nov. 30, 1993

[54] DRAWN AND IRONED CAN MADE OF A HIGH STRENGTH STEEL SHEET

[75] Inventors: Keiichi Shimizu; Junichi Tanabe; Fumio Kunishige, all of Yamaguchi, Japan

[73] Assignee: Toyo Kohan Co., Ltd., Tokyo, Japan

[21] Appl. No.: 823,494

[22] Filed: Jan. 21, 1992

[51] Int. Cl.[5] ..... B21B 1/46

[52] U.S. Cl. ..... 29/527.4; 148/518; 427/405

[58] Field of Search ..... 29/527.4; 146/518; 427/405

[56] References Cited

U.S. PATENT DOCUMENTS 3,772,091 11/1973 Mayer et al. .

FOREIGN PATENT DOCUMENTS 51-88415 8/1976 Japan .

*Primary Examiner*—Carl J. Arbes

*Attorney, Agent, or Firm*—Felfe & Lynch

[57] ABSTRACT

A method for making a tin-coated steel sheet useful in manufacture of drawn and ironed cans eliminates the annealing step used in other manufacturing processes. The steel sheet comprises a steel slab having specified trace amounts of carbon, silicon, manganese, sulphur, aluminum, nitrogen and phosphorus, and has excellent formability and corrosion resistance.

3 Claims, 1 Drawing Sheet

DRAWN AND IRONED CAN MADE OF A HIGH STRENGTH STEEL SHEET

FIELD OF THE INVENTION

The invention involves a method for manufacturing. A drawn and ironed can made of a high strength steel sheet. The steel sheet so produced is characterized by excellent formability and corrosion resistance. In addition, the process is extremely cost-efficient.

BACKGROUND AND PRIOR ART

Aluminum and steel, i.e., "tin plated" DI cans are widely used in the manufacture of internally pressurized drink containers. The beverages contained by the DI cans include carbonated beverages, beer, and so forth.

The number of such cans produced each year is enormous and competition is intense. Generally, the cans are manufactured by a standard industrial process. In this process, prepared steel is either batch annealed or continuously annealed. The steel so used should have a particular hardness, defined by Rockwell T Hardness Standard HR30T (Hardness: 49–64), and a thickness of from 0.25–0.35 mm. The hardness standard is an industry-wide recognized one.

The steel sheet referred to here is tin plated, after which it is drawn and ironed. This material, now drawn and ironed, will be used to make the tin can. First the portion of the steel which will be the can edge is trimmed. Then, a flange is formed for seaming with an end of the can.

Generally, before flanging is carried out, the portion of the can that will be the can top is subjected to what is referred to as the "neck in" process. This results in shortening the diameter of the can top. The steps described herein require that the surface treated steel sheet to be used for DI cans possess excellent drawing formability, ironing workability, neck-in formability, flange formability and corrosion resistance. In addition, the process must be carried out in an economical fashion.

One of the approaches that have been taken to making the described process more economical is the manner of treating steel sheets to render them thin. It is necessary that the thinned sheets have high strength pressure resistance at the can bottom. Coupled with this is the need for good flange formability and drawability, as well as iron workability.

One approach to improving flange formability and making high strength material is shown in Japanese Tokukaishou (Laid-Open Patent Publication) No. 51-88415. This reference teaches improved flange formability (i.e., a reduction of crack occurrence ratio by several percent during flange formation), together with a steel sheet having cold rolled texture of more than 80%. This is accomplished by limiting the chemical composition of the steel. Specifically, the carbon quantity is kept to less than 0.02%, the sulphur quantity to less than 0.01%, and the Al/C ratio at more than 3.5.

The cracking referred to supra during flanging occurs because flanging requires widening the diameter of the can top. Also, the material at the end portion of the can shows poor ductility.

The flange crack occurrence ratio regarded by Tokakaishou 51-88415 as excellent, however, is not acceptable with the industry standard of about 10 part per million in batch or continuously annealed processes. Achieving a low flange crack occurrence ratio is one goal of the invention.

SUMMARY OF THE INVENTION

The invention is a process for making a drawn and ironed can made of a high strength steel sheet manner more economical than those currently used. A key feature of this method is the omission of the annealing step which is standard in the art at present. The surface treated steel sheets so produced, when used to make DI cans, are found to produce less flange cracking than previously thought possible.

DETAILED DESCRIPTION OF PREFERRED EMBODIMENTS

Figure 1:
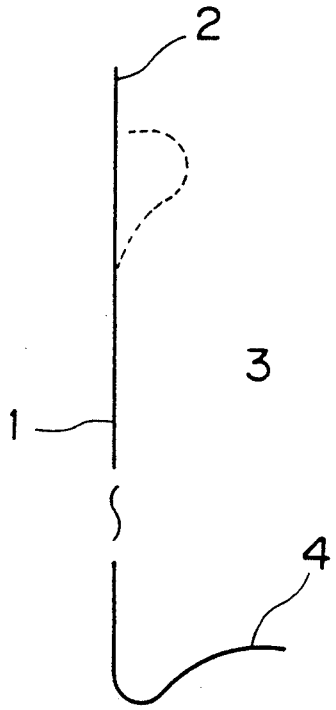
FIG. 1 shows the flange forming process referred to as the mouth squeezing method.

The invention involves a process for making a drawn and ironed can made of a high strength steel sheet. Steel of a particular composition elaborated upon infra is processed to make a hot roll strip, after which it is subjected to cold rolling, followed by cleaning, electric tin plating, and then can-making using the drawn and ironed process. After spray coating, flanges are formed following neck flange processes for mouth squeezing. Various parameters have been evaluated, and show the superiority of the resulting can.

The composition of the steel used in making DI cans is important. Various components must be controlled to maximize their benefits and minimize their drawbacks. For example, carbon ("C" hereafter) is contained in steel. Too much of it, however, hardens the steel and increases the energy needed for ironing. From the standpoint of energy consumption, low amounts of C are desirable, but if the amount of C lessens, drawability and ironability decrease. This seems to be why a lesser amount of C causes roughening of steel surfaces, and weak grain boundaries. This tendency seems to be very strong in steel of lesser ductility; however, in annealed steel, lower C brings about better drawability. A low amount of C is not desirable for neck flange processes using the mouth squeezing method.

If wall surfaces are roughened, then coating cracks and steel cracks (squeezing cracks) can result. To that end, limits have been placed on the amount of C in the steel, as explained below, but the amount of C should range from 0.01 to 0.06% by weight. All ranges provided herein are by weight.

Silicon ("Si" hereafter), also present in steel, hardens it and causes squeezing cracks to occur very easily if too much is present. To that end, the maximum amount of Si permitted is 0.03%.

Manganese ("Mn") hardens steel, and it is desirable to keep this amount as low as possible. It has been determined, therefore, that the amount of Mn, taken with the amount of C, must satisfy the following equation:

$$0.8 > Mn\ \% + 10(C\ \%).$$

However, Mn also prevents brittleness in the steel caused by sulphur "S" hereafter). Thus, when adding Mn, the amount of S must also be considered. It has been found that the relationship between Mn and S must satisfy the following equation:

$$0.2 > Mn\ \% - 10(S\ \%).$$

S should be added, however, because it improves corrosion resistance to drinks containing phosphoric acid, a widely used ingredient. The S quantity must be more than 0.01%, and the maximum is 0.03%. Improved corrosion resistance does not seem to increase over an amount of 0.03%.

Aluminum ("Al" hereafter) must also be added for deoxidization of molten steel. It is necessary to add more than 0.02% to accomplish this; however, too much Al will cause steel surface defects to occur easily and will increase the cost. The maximum amount of Al permitted, in view of these considerations, is 0.10%.

Additional components include nitrogen ("N") and phosphorus ("P"). These harden steel, and the amount permitted is set at a maximum of 0.006% (N), and 0.03% (P).

Maximum hardness after cold rolling is set in relation to wrinkles which form at the bottom of a DI can. These occur radially during formation of the bottom, and compromise the appearance of the goods, which is of course undesirable. An additional factor which affects wrinkle formation is steel thickness.

If the hardness is increased, then the thickness of the steel must be set in a way which prevents one of the aims of the invention, which is to reduce thickness while maintaining high strength. To that end, minimum hardness is set at 73, in accordance with the HR scale (HR 30T) cited supra. Sufficient reduction of steel thickness cannot be achieved when the hardness is below this value.

In view of concerns regarding wrinkles, maximum and minimum thickness of steel are set in relation with hardness and cost. In addition, there are limitations on coating weight. Explanations for both of these parameters are set forth below.

When tin coating of an outside surface for a steel sheet destined to become a can is less than 1.0 g/m$^2$, then cracks occur easily during ironing, and continuous ironing becomes difficult. The minimum tin coating for the inside surface is set at 0.1 g/m$^2$. This minimum is set in relationship to considerations of corrosion resistance, rust resistance, and stripping (i.e., removal of the ironed can from an ironing punch). Maximum coating is 11.0 g/m$^2$, for cost considerations.

After steel in accordance with the invention is hot rolled, it is desirable that it be coiled at a temperature of more than 600° C. This temperature is desirable (i) to reduce energy necessary for forming DI cans, (ii) to improve neck flange formability when using the mouth squeezing method with hot rolled band softening, and (iii) to reduce soluble N by self-annealing after coiling. However, any scale formed on the hot band of steel cannot be easily removed if the coiling temperature is more than 750° C. Thus, the range of more than 600° C. and no more than 750° C. for coiling temperature is desirable.

In addition, a preferred ratio between thickness before cold rolling and after cold rolling is used. This ratio is $$\frac{To - T1}{To} \times 100$$

where To is the thickness of the steel sheet before cold rolling (i.e., that of the hot strip) and T1 is the thickness after cold rolling, is preferably from 60 to 90%, making the final thickness of the steel sheet from 0.18 to 0.28 mm.

When a rolling ratio, i.e., the ratio described supra is less than 60%, it is necessary to set the maximum thickness of the hot rolled band at about 0.5 mm. Current hot rolled band manufacturing technology is such that at a thickness of 0.5 mm, there is difficulty in securing uniform characteristics for the sheet. The minimum of 60% is set in view of these concerns, while the maximum is set for considerations of drawing, ironing workability, and formability of neck flange processes using the mouth squeezing methodology.

The following exemplification will explain the invention more fully.

EXAMPLE

Steel of various compositions as shown in Table 1, below, was processed in a converter, and a steel slab of 220 mm thickness was made via continuous casting. This was then hot rolled to make a hot roll band.

TABLE 1

| Steel No. | C | Si | Mn | S | Al | P | (weight %) N |
|---|---|---|---|---|---|---|---|
| 1 | 0.003 | 0.02 | 0.28 | 0.008 | 0.052 | 0.018 | 0.0028 |
| 2 | 0.013 | 0.01 | 0.22 | 0.018 | 0.059 | 0.015 | 0.0025 |
| 3 | 0.031 | 0.01 | 0.23 | 0.022 | 0.043 | 0.011 | 0.0020 |
| 4 | 0.032 | 0.01 | 0.25 | 0.007 | 0.038 | 0.013 | 0.0033 |
| 5 | 0.031 | 0.01 | 0.28 | 0.026 | 0.066 | 0.008 | 0.0070 |
| 6 | 0.049 | 0.01 | 0.33 | 0.028 | 0.055 | 0.016 | 0.0035 |

Cold rolling followed, using a rolling ratio as shown in Table 2. Additional parameters of the experiments are also set forth in Table 2. Following this, the steel was cleaned, and tin plated electrically (2.8 g/m$^2$ for inside and outside). Cans were then made (diameter 65 mm), using drawing and ironing processes.

The cans were spray coated, and then flanged using the neck flange process of mouth squeezing method. Evaluated criteria were workability for drawing and ironing (limiting drawing ratio, ironing energy), wrinkle formation at the bottom of the can (formation right after ironing), cracking of organic coating in the neck flange process, squeezing cracks in the metal, and corrosion resistance. The latter was tested using a cola drink containing phosphoric acid.

In Table 2, which summarizes the results, ⊚ means an excellent result, O a good result, Δ an unacceptable result, and X a failure.

Figure 2:
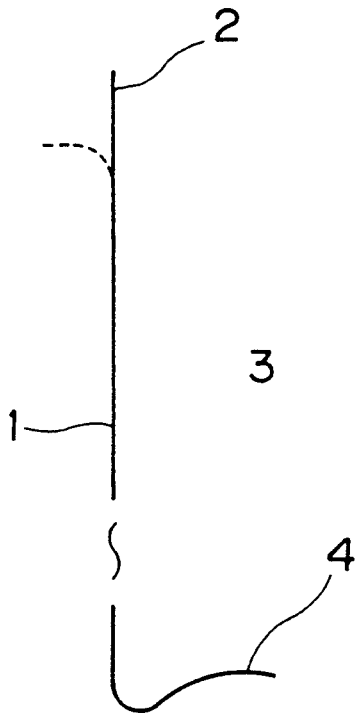
FIG. 2 shows a flange forming process by which can diameter is widened.

The results show that by setting steel composition, manufacturing processes and conditions, even though flange forming was limited to mouth squeezing methodologies, useful cans are produced in an economical manner and without an annealing step. FIG. 1 shows the neck flange process for mouth squeezing methodology, as used herein. Solid lines show structure before application of the methodology, and broken lines after application. In FIG. 1, reference number 1 shows the can wall, 2 the can edge, 3 the central part of the can, and 4 the can bottom. The same reference numbers are used to represent the same structures in FIG. 2, showing the flange forming method with mouth diameter widening.

Thus, the foregoing provides a methodology for making a steel sheet useful in manufacture of a DI can. Steel of a particular composition is used, pickled and then cold rolled to yield steel having hardness of from 73 to 83 using (HR 30T) standard, and a thickness of 0.18 to 0.28 mm. The steel is tin-plated or coated on both sides, where the outer surface coating ranges from 1.0 to 11.0 g/m$^2$, and the inner surface from 0.1 to 11.0 g/m$^2$. This is accomplished without annealing. Also embraced by the invention is a product produced following the above process.

TABLE 2

| Steel No. | Coiling Temperature (°C.) | Cold Rolling Ratio (%) | Thickness (mm) | Hardness (HR30T) | Evaluated Item: Wrinkle at Can Bottom | Drawing Limit | Drawing & ironing energy | Crack of Organic coating | Squeezing crack of metal | Corrosion resistance | Classification |
|---|---|---|---|---|---|---|---|---|---|---|---|
| 1 | 640 | 86 | 0.25 | 76 | ◎ | X | ◎ | X | Δ | X | C |
| 2 | 640 | 86 | 0.25 | 78 | ◎ | ○ | ◎ | ○ | ○ | ○ | I |
| 3 | 640 | 75 | 0.25 | 80 | ○ | ◎ | ◎ | ○ | ○ | ○ | I |
| | 640 | 86 | 0.25 | 82 | ○ | ◎ | ○ | ○ | ○ | ○ | I |
| | 640 | 92 | 0.25 | 84 | X | ○ | Δ | Δ | Δ | Δ | C |
| | 640 | 88 | 0.21 | 82 | Δ | ◎ | Δ | ○ | Δ | ○ | I |
| | 640 | 84 | 0.28 | 82 | ◎ | ◎ | ○ | ○ | ○ | ○ | I |
| | 560 | 86 | 0.25 | 83 | Δ | ○ | Δ | ○ | Δ | ○ | I |
| 4 | 640 | 86 | 0.25 | 82 | ○ | ◎ | ○ | ○ | ○ | X | C |
| 5 | 640 | 86 | 0.25 | 84 | Δ | ○ | X | ○ | X | ○ | C |
| 6 | 640 | 86 | 0.25 | 83 | Δ | ○ | X | ○ | Δ | ○ | C |
| | 560 | 86 | 0.25 | 84 | X | ○ | X | ○ | Δ | ○ | C |

I: this invention
C: conventional

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

We claim:

1. A drawn and ironed (DI) can consisting essentially of a high strength steel sheet, wherein said can is manufactured in a process comprising drawing, ironing and neck-in forming employing a mouth squeezing method, and wherein said steel sheet is manufactured in a method comprising the following steps:

(i) hot rolling a steel strip wherein said steel contains carbon, silicon, manganese, sulphur, aluminum, nitrogen and phosphorus in the following amounts by weight:

| | |
|---|---|
| carbon: | from 0.01 to 0.06% |
| silicon: | less than 0.03% |
| manganese: | from 0.1 to 0.4% |
| sulphur: | from 0.01 to 0.03% |
| aluminum: | from 0.02 to 0.10% |
| nitrogen: | less than 0.006% |
| phosphorus: | less than 0.03% |

including a remainder of iron and other inevitable impurities, wherein $$Mn\ \% + 10(C\ \%) > 0.8$$

and $$Mn\ \% - 10(S\ \%) > 0.2,$$

(ii) pickling said steel strip, (iii) cold rolling the pickled steel strip to produce a steel sheet having a hardness of from 73 to 83 (HR3)T) and a thickness of from 0.18 to 0.28 mm, and (iv) tin-coating both sides of said steel sheet, wherein the side to become an outer surface of the can and the side to become an inner surface of the can are coated at weights from 1.0 to 11.0 g/m$^2$ and from 0.1 to 11.0 g/m$^2$, respectively, wherein said steel is not annealed.

2. A can made by the method of claim 1, wherein said steel sheet is coiled at a temperature of from 600° C. to 750° C. after hot rolling.

3. A can made by the method of claim 1, wherein the reduction ratio of cold rolling after hot rolling and pickling is from 50 to 90%.

* * * * *